United States Patent [19]

Petrie et al.

[11] 3,971,556

[45] July 27, 1976

[54] COMBINATION BOOK END AND DUMBELL APPARATUS AND METHOD OF UTILIZING SAME

[76] Inventors: Robert D. Petrie, 28890 W. Chicago, Livonia, Mich. 48150; Thomas E. Wensley, 22034 Gregory, Dearborn, Mich. 48124; Charles Watkins, 19401 Newburg Road, Livonia, Mich. 48151; Juan Gaminde, 29610 Grandon, Livonia, Mich. 48150

[22] Filed: Oct. 10, 1974

[21] Appl. No.: 513,886

[52] U.S. Cl. ..... 272/122; D6/107; 211/42

[51] Int. Cl.[2] ..... A63B 11/00

[58] Field of Search ..... 272/84; 211/42, 43; D6/106–110; 273/136 E

[56] References Cited

UNITED STATES PATENTS

| | | | |
|---|---|---|---|
| 825,955 | 7/1906 | Bohache | 272/84 |
| 937,225 | 10/1909 | Burr | 272/84 |
| 1,409,136 | 3/1922 | Dixon | 211/43 |
| 3,268,224 | 8/1966 | Freshour | 272/84 X |
| 3,520,537 | 7/1970 | Peebles | 273/136 E X |
| 3,819,184 | 6/1974 | McPhail et al. | 273/136 E X |
| D52,904 | 1/1919 | Young | D6/106 |
| D61,328 | 8/1922 | Reber | D6/107 |

FOREIGN PATENTS OR APPLICATIONS

| | | | |
|---|---|---|---|
| 8,624 | 5/1889 | United Kingdom | 211/42 |

OTHER PUBLICATIONS

British Southall – 3545 Exercising Dumbells & Clubs p. 3268 9/24/1887.

*Primary Examiner*—Paul E. Shapiro
*Attorney, Agent, or Firm*—Irving M. Weiner; Pamela S. Burt

[57] ABSTRACT

A set of book ends removably receive dumbells. Each book end comprises a horizontal member with a stud at one end and a vertical member affixed to the horizontal member between the stud and the other end. Each dumbell comprises a short bar between two enlarged end portions, with one end portion having a cavity to mate with the stud.

5 Claims, 3 Drawing Figures

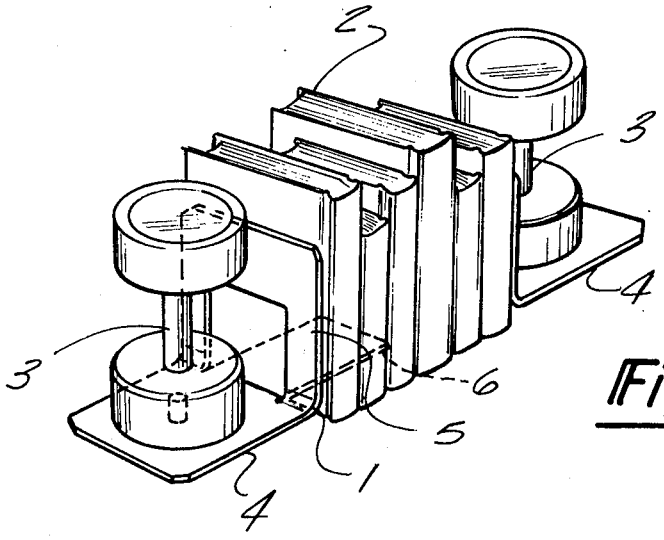
Fig-1
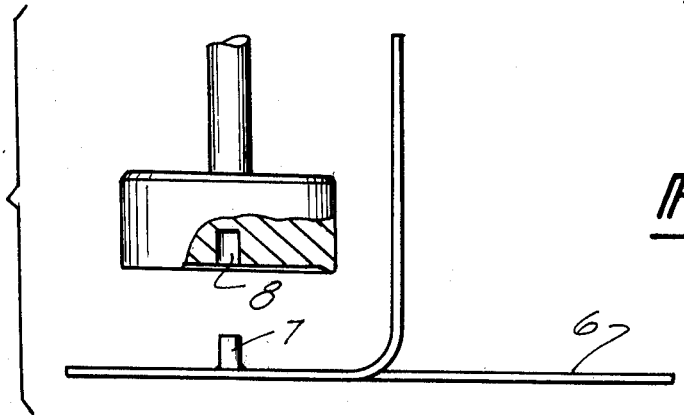
Fig-2
Fig-3
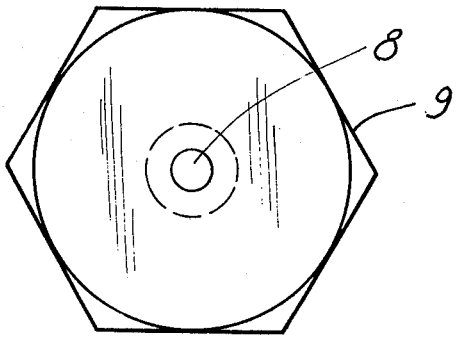

COMBINATION BOOK END AND DUMBELL APPARATUS AND METHOD OF UTILIZING SAME

The present invention relates to a novel combination exercise and book end device.

BACKGROUND OF THE INVENTION

Heretofore, supportive apparatus for books have been, generally of two types.

A first genre of bookends comprises two perpendicular blocks which have two of their sides at right angles. In operation the vertical blocks of the bookends are pressed against each end of a row of books; the books are retained in an upright position supported by the weight of the bookends and by friction between the bookends and the surface. This embodiment is advantageous in its capacity for aesthetically appealing adaptation and in that certain useful objects may be encorporated into its structure, as suggested by Weston, British Patent No. 8624. However, a major drawback in this bookend arrangement lies in the face that the bulb of the weight of the bookends is required for the support of the books. Consequently, the objects incorporated into such bookends must be largely stationary, such as boxes, ink wells or sconces.

A second type of bookend comprises two perpendicular sections wherein the horizontal member includes a tongue upon which the end books of a row rest. The chief advantage of this bookend lies in the fact that the books are supported by their own weight, thus eliminating the need for a heavy, supportive horizontal section.

As a result, this type of bookend is uniquely suited to the incorporation of useful or ornamental articles which may be used entirely independent of the bookend as their weight is not required for the support of books.

SUMMARY OF THE INVENTION

The present invention provides a supportive apparatus for books upon which is removeably mounted a device for physical exercise.

It is generally recognized that executives often have little opportunity for exercise due to the sedentary nature of their jobs and the demands of their schedules. Further, the decorous environment of an executive's office generally precludes the storage of ordinary gymnastic equipment.

Therefore, this invention provides a functional pair of exercise weights, consistent with an office environment to afford busy executives an opportunity to exercise in the privacy of their office.

This invention also provides a novel set of bookends which are aesthetically pleasing as well as dually functional.

BRIEF DESCRIPTION OF THE DRAWINGS

The invention will now be further explained with reference to the accompanying drawings in which:

FIG. 1 is a side elevational view of the novel bookends together with the set of novel dumbbells in their operative, home or at rest position.

FIG. 2 is a side view, partly in section, illustrating the upstanding pin on the horizontal portion of the bookends and the complementary cavity in the end portion of the dumbbell.

FIG. 3 shows the end portion and cavity of an alternate embodiment of the novel dumbbell.

DETAILED DESCRIPTION

With particular reference to FIGS. 1 and 2, a set of bookends 1 is used to support arow of books 2 and to removeably receive a set of dumbbells 3. In a preferred embodiment each bookend comprises a horizontal portion 4 and a vertical portion 5. The horizontal portion 4 includes, to one side of said vertical portion 5 a tongue 6. In use, the vertical portion of each bookend is pressed against the last volume of the row of books 2, and the books at the end of the row rest upon the tongue 6 of the horizontal portion 4 of the bookend 1. In this way, the row of books 2 is supported essentially by its own weight.

The horizontal portions 4 of the bookends 1 also include on each side not occupied by the tongue 6 an upstanding pin or stud 7.

The dumbbells 3, when not in use, rest on the horizontal portion of the bookend 1. Each dumbbell 3 is provided at one end portion with a cavity or bore 8 which is adapted to receive and mate with the upstanding pin or stud 7 on the horizontal portion 4 of the bookend 1.

When the dumbbells are not in use they rest upon the upstanding pin 7 on the horizontal portion 4 of each bookend 1. When exercise is desired, the dumbbells 3 are simply lifted off the studs 7. This is possible since the weight of the dumbbells is not required for the support of the books as the row of books 2 is supported by its own weight upon the bookend tongue 6. An additional advantage of this novel bookend lies in the fact that when the dumbbells 3 are in place on the bookends 1, they furnish additional support to the row of books and can help to stabilize the system when books are removed for use.

In a preferred embodiment each dumbbell 3 weighs approximately 15 pounds although the weight of the dumbbells may be varied to provide bookend dumbbells for different levels of physical development.

It is further anticipated that the end portions 9 of the dumbbells may be designed in any cylindrical or polygonal shape desired to enhance the aesthetic appeal of the novel bookend dumbbells (FIG. 3).

We claim:

1. A device for physical exercise removeably mounted on a supportive apparatus for books and other office material;

said supportive apparatus comprises at least one horizontal member with a stud affixed to a first section of said horizontal member, a tongue comprising a second section of said horizontal member, a vertical member affixed to said horizontal member at the end of said tongue toward said stud;

said device for physical exercise comprises a dumbbell having a short bar between two enlarged end portions, with one end portion of said device being flat on the bottom side with at least one cavity, shaped and oriented to mate with said stud, so that said device may be readily removed from said apparatus, the said end portion being of any suitable geometric shape, the short bar between the said end portions being long enough to accept a clenched fist.

2. A device according to claim 1 wherein said dumbbell has end portions of cylindrical configuration.

3. A device according to claim 1 wherein said dumbbell has end portions of polygonal configuration.

4. A device according to claim 1, wherein:

said supportive apparatus comprises at least one book end; and said device for physical exercise comprises a set of dumbbells.

5. A device for physical exercise removably mounted on a supportive apparatus for books, comprising, in combination:

a dumbbell having two enlarged end portions interconnected by an elongated central member, a supportive apparatus including a substantially horizontal member and a substantially vertical member integral with said horizontal member;

said horizontal member has a first section provided with a substantially vertically-oriented projection;

one end portion of said dumbbell being provided with a cavity to fit upon said projection;

said vertical member against which said books may rest and having an aperture; and said horizontal member has a second section upon which at least some of said books may rest and which has dimensions corresponding to the dimensions of said aperture in said vertical member.

* * * * *